US005555484A

United States Patent [19]

Dye et al.

[11] Patent Number: 5,555,484

[45] Date of Patent: Sep. 10, 1996

[54] ELECTROMAGNETIC DOOR HOLDER SYSTEM

[75] Inventors: William P. Dye; Paul J. Hoggard, both of Indianapolis, Ind.

[73] Assignee: Von Duprin, Inc., Indianapolis, Ind.

[21] Appl. No.: 222,042

[22] Filed: Apr. 4, 1994

[51] Int. Cl.[6] ..... H01F 7/18

[52] U.S. Cl. ..... 361/144; 361/206

[58] Field of Search ..... 361/819, 139, 361/152, 160, 144, 143, 104; 327/525; 307/72, 75; 335/285, 289, 290, 291; 70/280, 281, 282; 292/251.5

[56] References Cited

U.S. PATENT DOCUMENTS

| | | | |
|---|---|---|---|
| 1,406,039 | 2/1922 | Lee | 361/104 X |
| 2,472,397 | 6/1949 | Bennett | 292/70 |
| 3,533,652 | 10/1970 | Crane et al. | 292/251.5 |
| 3,913,958 | 10/1975 | Larime | 292/251.5 |
| 4,696,500 | 9/1987 | Zunkel | 292/251.5 |
| 5,139,293 | 8/1992 | Zimmerman et al. | 292/251.5 |

*Primary Examiner*—Fritz M. Fleming
*Attorney, Agent, or Firm*—Robert F. Palermo; A. James Richardson

[57] ABSTRACT

An electromagnetic doorholder for retaining a door in an open position by magnetic interaction with an armature secured to the door. The doorholder includes a core having a face confronting the armature and a coil of wire surrounding the core. A cup having an inside diameter somewhat greater than the coil outside diameter receives the coil, the core extending from the face to the cup bottom. A power control circuit including a resistor circuit controls electrical power supplied to the coil, the power control circuit being mounted on a circuit board situated between the coil rear surface and the cup bottom. The resistor circuit being situated in sufficiently close proximity to the cup bottom for transfer of heat from the resistor circuit to the cup. The power control circuit also includes a low resistance circuit coupled to the resistor circuit, the low resistance circuit including a fusible link, the fusible link being selected to carry current when the power input terminals are coupled to a lower voltage power source and to stop carrying current when the power input terminals are coupled to a higher voltage power source.

7 Claims, 2 Drawing Sheets

ELECTROMAGNETIC DOOR HOLDER SYSTEM

BACKGROUND OF THE INVENTION

The present invention relates generally to door holders of the type employing an electromagnet to maintain a door such as a fire door in an open position. The invention particularly relates to a coil assembly and power control circuit for such a door holder.

Door holders which incorporate an electromagnet are well known as shown in several U.S. Patents. The door holder is typically employed with an armature assembly which is mounted to a door and is also well known in the art.

Generally, electromagnetic door holders are designed to be supplied electric power at 12, 24 or 120 volts. Some units are designed for operation with alternating current while other units rely on a supply of direct current. Some magnetic door holders are known which will work on either alternating or direct current by incorporating some sort of rectifier circuit.

In use, door holders typically operate in an essentially continuous fashion for maintaining fire doors and the like in an open position. In the event of a fire or other emergency, power supplied to the door holder is removed thus allowing the door to close under influence of a biasing force. Since the door holder in normal conditions is continuously operative, it is desirable to minimize the power requirement of the door holder to conserve electric power and the related costs.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

A door holder in accordance with the present invention includes a coil of wire situated around a cylindrical core, the core having a face confronting an armature secured to a door. The coil of wire and core is positioned within a cup, a lip of the cup defining the outer perimeter of the magnetically interactive face of the door holder. The cup includes a metal bottom which, in addition to providing a mounting function, acts as a heat sink for a power control circuit which is mounted within the cup adjacent to the coil. A resistor circuit within the power control circuit is situated in sufficiently close proximity to the cup bottom for an appreciable transfer of heat to occur from the resistor circuit to the cup for dissipation to the surrounding environment.

The power control circuit includes a pair of power input terminals adapted to be coupled to any power source having an output voltage within a selected range. A resistor circuit has an input coupled to a first of the power input terminals and has a resistor circuit output. The resistor circuit provides a potential drop in the event the power input terminals are coupled to a source at the high end of the selected range. A rectifier circuit is incorporated in the power control circuit which has a first rectifier input coupled to the resistor circuit output and a second input coupled to the second power input terminal. The rectifier circuit has first and second rectifier circuit outputs which are connected to the electromagnetic coil. The rectifier circuit converts any alternating current input into a direct current output. Additionally, there is a low resistance circuit coupled to the resistor circuit, the low resistance circuit including a fusible link. The fusible link is selected to carry current to the rectifier circuit when the power input terminals are coupled to a low voltage power source and to stop carrying the current when the power input terminals are coupled to a higher voltage power source.

The low resistance circuit operates as an automatic selection circuit so the unit can operate on two or more different voltages. Since it is unlikely that a given door holder would be switched from one voltage source to another voltage source once it is installed, the unit is designed so if the unit is coupled to a 120 volt source, it cannot later be used on a 24 volt source.

One feature of the invention is a coil protection circuit intended to protect the coil when the door holder is first connected to a power source, particularly to a high voltage power source. The protection circuit is preferably a zener diode having an avalanche voltage significantly below the voltage produced by the output of the rectifier circuit when the power input terminals are connected to a high voltage source. In such a situation, the current output from the rectifier circuit travels preferably through the zener diode thereby preventing the coil from any high current surge. The momentary flow of current through the zener diode is also sufficient to cause the fusible link in a resistant circuit to trigger or blow. The alternative path provided by the zener diode protects the coil from any slow blowing operation of the fusible link. Once the fuse is blown or if the door holder is run on a lower voltage, the zener diode does not operate as a factor in the circuit except to protect the door holder coil in the event of lightning strike or the like.

The preferred coil employed is one having a very low current draw of 25 milliamps or less, preferably about 19 milliamps. This low current draw, coupled with the placement of the resistant circuit allows the cup to perform all of the necessary heat sinking function required of the circuit so that no external additional heat sinking is required.

Other features and advantages of the invention will become apparent to those skilled in the art upon consideration of the accompanying figures illustrating the preferred embodiment of the invention.

DESCRIPTION OF THE PREFERRED EMBODIMENT

Figure 1:
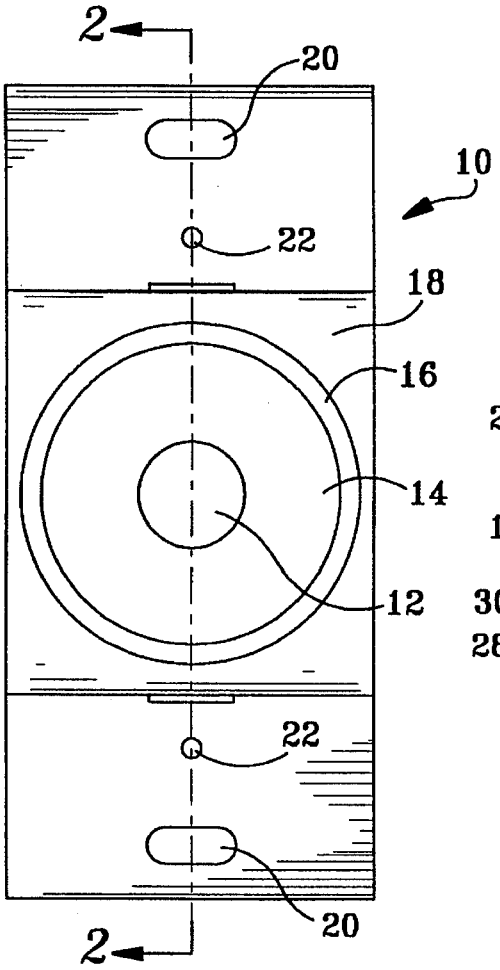
FIG. 1 is a front elevation view showing a magnetic door holder according to the present invention.

An electromagnetic door holder is shown in FIG. 1 to comprise a core 12 surrounded by a coil 14. The core and coil are received within cup 16 which is fixed to a bracket 18. The bracket 18 includes mounting holes 20 for mounting the bracket to a wall. The bracket 18 also includes holes 22 adapted to receive fasteners for securing a decorative facie (not shown) surrounding the cup 16 subsequent to attachment of the door holder to a supporting wall.

Figure 2:
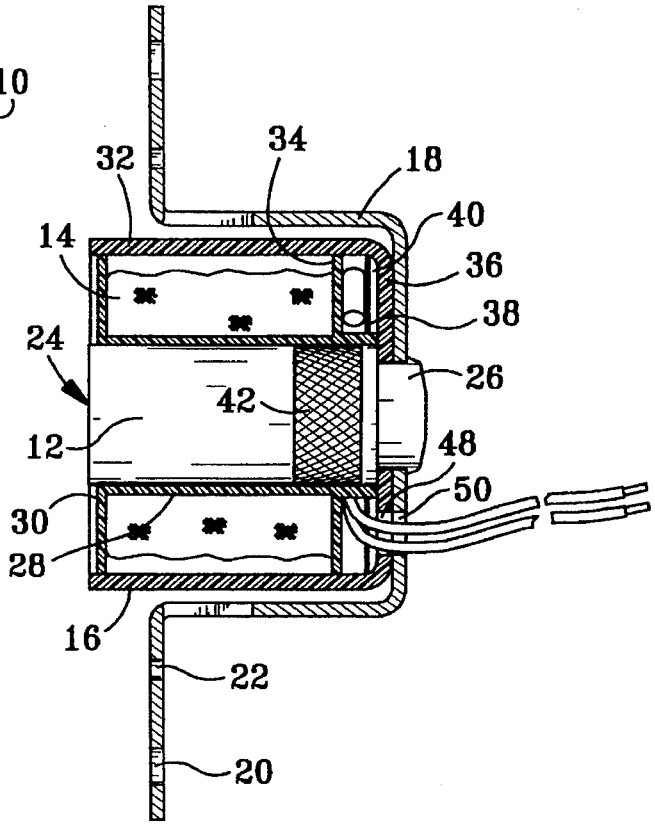
FIG. 2 is a sectional view of the door holder shown in FIG. 1 taken along lines 2—2.

Turning to FIG. 2, it will be noted that core 12 comprises a cylindrical body with a first end 24 intended to confront a mating armature (not shown) and a second end 26 which projects through an opening in the bottom of cup 16 and bracket 18. The end 26 is swaged or rolled outward to maintain the core 12, cup 16 and bracket 18 together as a single structural unit.

The coil 14 is shown to comprise a bobbin including a hollow cylindrical member 28. A first flange 30 extends radially outward from the front end of the hollow cylindrical member 28 from the core 12 to the wall 32 of cup 16. A second radial flange 34 extends outwardly from a position spaced some small distance from the bottom 36 of cup 16. A winding of wire forming the coil 14 is supported on the bobbin between the radial flanges 30 and 34. The end 38 of the coil bobbin abuts the bottom 36 of cup 16. The end 38 of the bobbin supports a printed circuit board 40 on which is mounted a power control circuit.

Figure 3:
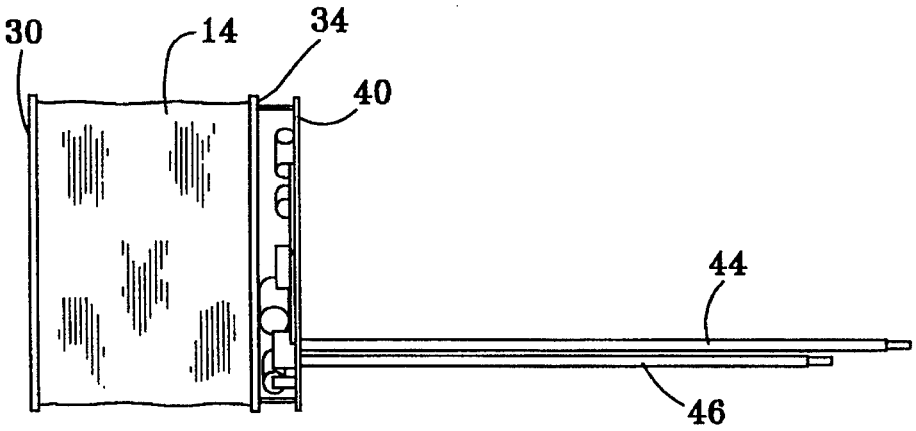
FIG. 3 is a side elevation view of the coil assembly shown in FIG. 2.

The bobbin including the coil and printed circuit board 40 constitutes a separate assembly shown in FIG. 3 which is inserted into cup 16 and held in place by frictional engagement between the cylindrical portion 28 of the bobbin and a knurled portion 42 of core 12. Power input terminals 44 and 46 project through small openings 48 and 50 in the bottom of the cup 16 and bracket 18 respectively.

Figure 4:
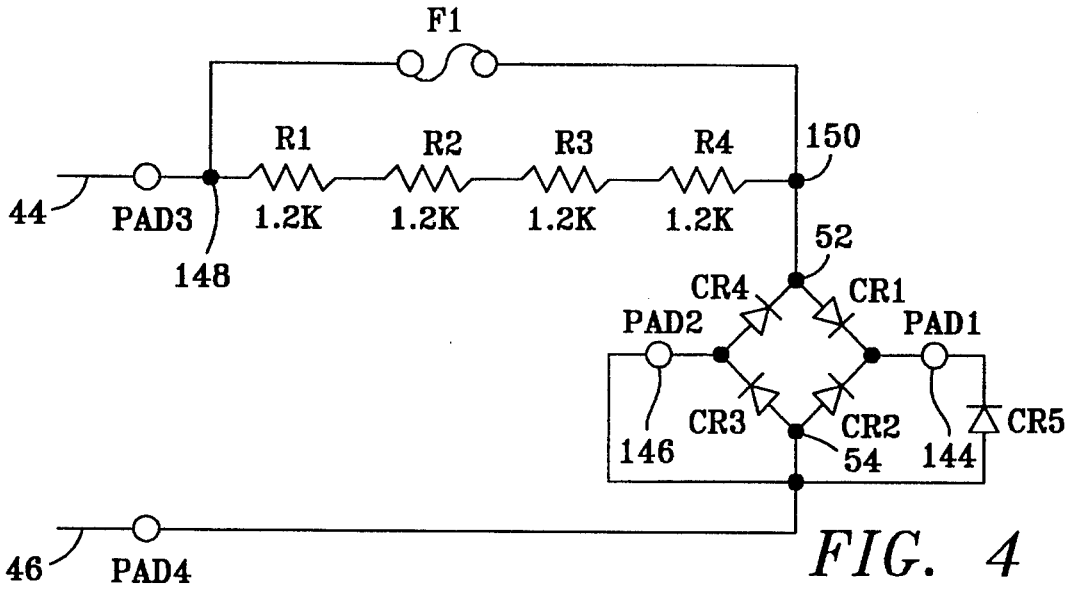
FIG. 4 is a schematic diagram of a power control circuit in accordance with the present invention.
Figure 5:
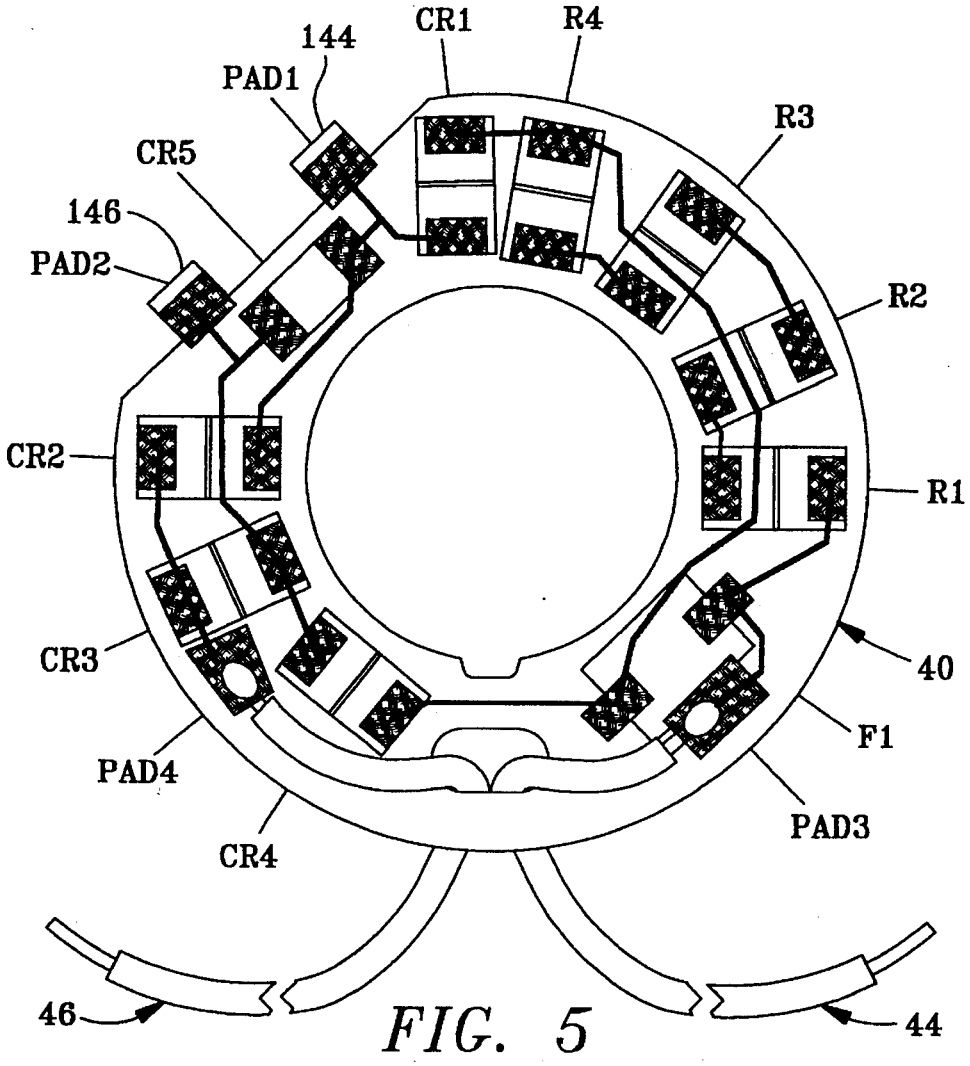
FIG. 5 is a plan view of the reverse side of a circuit board for the power control circuit shown in FIG. 4.

The power control circuitry mounted on printed circuit board 40 is shown schematically in FIG. 4. A layout design of the printed circuit board is shown in FIG. 5. A first power input terminal 44 is connected by way of PAD3 to input 148 of a resistor circuit shown to comprise resistors R1, R2, R3 and R4, shown here as four 1200 ohm resistors in series, totalling 4800 ohms and resulting in a 25 mA current under a 120 V potential. The four resistors are employed in preference to a single resistor to insure that adequate heat transfer can occur to the surrounding environment. The output of the resistor circuit 150 is coupled to an input 52 of a rectifier circuit formed by the four diodes CR1, CR2, CR3 and CR4. The second input 54 is coupled to the second of the power input terminals 46 at PAD4. The coil 14 for the electromagnet is coupled to the outputs 144, 146 of the rectifier circuit at PAD1 and PAD2, respectively.

A low resistance circuit including the fusible link F1 has first and second ends coupled between input 148 and output 150 of the resistor circuit, respectively. When input terminals 44 and 46 are connected to a low voltage power source such as a 24 volt source, current flows from the power input terminal 44 to the rectifier circuit by way of the low resistance circuit including fusible link F1. The current carrying capabilities of the fusible link are selected based on the internal resistance of the coil connected between pads 1 and 2 to insure the fusible link will continue to carry at this low input voltage the current necessary to power the electromagnet coil.

When the power input terminals 44 and 46 are connected to a higher voltage power source, for example a 120 volt power source, the current through the fusible link F1 of the low resistance circuit increases to such a point that the fusible link burns out and ceases to carry any current. As a result, the current from the power input terminal must traverse the resistors R1–R4 of the resistor circuit resulting in a potential drop between the input 148 and output 150 of the resistor circuit and insuring that the electromagnet coil will not be burned out. To insure the fusible link F1 will burn out fast enough to protect the coil, a zener diode CR5 is connected between PAD1 and PAD2. The zener diode preferably has a avalanche voltage of about one-half of the voltage of the higher voltage power source to which the circuit may be applied. Assuming the higher of the two voltages to which the circuit might be applied is 120 volts, the zener diode CR5 is selected to have a avalanche voltage of about 60 volts. When the power input terminals 44 and 46 are coupled to a 120 volt source, the voltage between PAD1 and PAD2 is sufficient to cause the zener to avalanche thus causing a momentary surge through the fusible link F1 which insures a faster than normal burnout of the fuse thus protecting the coil from any abnormally slow operation of the fuse F1.

In the preferred embodiment, the circuit is intended for use on either 24 or 120 volt sources. The zener is selected to have a 60 volt avalanche voltage. The coil is preferably one requiring less than 25 milliamps to develop the required magnetic field. In the preferred embodiment, the coil requires only 19 milliamps to develop a magnetic flux of approximately 10850 Gauss. In the preferred embodiment, the coil provides a holding force in the range of about 35 to 50 pounds as a result of developing a magnetomotive force of approximately 201 amp-turns. Thus, a current of 19 milliamps in a coil of nominally 10,600 turns will provide the desired holding force. The same force can, of course, be achieved by a coil of 8,000 turns at 25 milliamps or 10,000 turns at 20 milliamps. The specific method of achieving the approximately 10,000 Gauss and 200 amp-turns desired depends on desired mechanical and physical attributes of the coil such as size and mechanical durability, cost, and maximum $I^2R$-generated temperature rise which can be dissipated by the heat sink action of the cup 16 during operation.

It will be appreciated by those skilled in the art the same principles can be used with coils of different carrying capacity for use on other power sources. Other modifications and uses for the invention will become apparent from the disclosure to those skilled in the art which invention is defined by the following claims.

What is claimed is:

1. An electromagnetic door holder system for use with a variety of power sources comprising:

a pair of power input terminals adapted to be coupled to any power source having an output voltage within a selected range;

a resistor circuit having an input coupled to a first of the power input terminals and having a resistor circuit output;

a rectifier circuit having a first rectifier input coupled to the resistor circuit output, having a second input coupled to a second of the power input terminals;

an electromagnetic coil having a first end coupled to the first rectifier circuit output and having a second end coupled to the second rectifier circuit output; and a low resistance circuit having a first end coupled to the resistor circuit input and having a second end coupled to the resistor circuit output, the low resistance circuit including a fusible link, the fusible link being selected to carry current to the rectifier circuit when the power input terminals are coupled to a lower voltage power source and to stop carrying current when the power input terminals are coupled to a higher voltage power source.

2. The electromagnetic door holder system of claim 1 further comprising a coil current protection circuit having a first end coupled to the first rectifier circuit output and having a second end coupled to the second rectifier circuit output, the coil current protection circuit carrying current when the power input terminals are coupled to said higher voltage power source and not carrying current when the power input terminals are coupled to said lower voltage power source.

3. The electromagnetic door holder system of claim 2, wherein the rectifier circuit comprises a full-wave bridge rectifier, and the coil current protection circuit comprises a zener diode having an avalanche voltage significantly below the voltage of the power input terminals, when connected to a power source having an output voltage near a maximum voltage of said selected range.

4. The electromagnetic doorholder system of claim 1 wherein the resistor circuit comprises sufficient resistance to permit less than 25 milliamps of current to flow through the electromagnetic coil when the pair of power input terminals are coupled to a power source of 120 volts.

5. The electromagnetic doorholder system of claim 1 wherein the electromagnetic coil comprises a sufficient number of turns of wire to develop a magnetic flux of more than 10,000 Gauss when carrying a current not greater than 25 milliamps.

6. The electromagnetic doorholder system of claim 1 wherein the electromagnetic coil comprises a sufficient number of turns of wire to develop a magnetomotive force of more than 200 amp-turns when carrying a current not greater than 25 milliamps.

7. The electromagnetic doorholder system of claim 1 wherein the electromagnetic coil comprises a sufficient number of turns of wire to develop a holding force of between about 35–50 lbs. when carrying a current not greater than 25 milliamps.

* * * * *